US011608214B2

(12) United States Patent
Tassias

(10) Patent No.: US 11,608,214 B2
(45) Date of Patent: Mar. 21, 2023

(54) DEVICE FOR SQUEEZING OUT TUBES

(71) Applicant: The Cube Club Platform GmbH, Wiesbaden (DE)

(72) Inventor: Stilianos Tassias, Wiesbaden (DE)

(73) Assignee: The Cube Club Platform GmbH, Wiesbaden (DE)

( * ) Notice: Subject to any disclaimer, the term of this patent is extended or adjusted under 35 U.S.C. 154(b) by 0 days.

(21) Appl. No.: 17/225,749

(22) Filed: Apr. 8, 2021

(65) Prior Publication Data

US 2021/0292050 A1 Sep. 23, 2021

Related U.S. Application Data

(63) Continuation of application No. PCT/EP2019/076043, filed on Sep. 26, 2019.

(30) Foreign Application Priority Data

Oct. 8, 2018 (DE) ..... 10 2018 124 694.3

(51) Int. Cl.
*B65D 35/28* (2006.01)
*B65D 35/40* (2006.01)

(52) U.S. Cl.
CPC ..... *B65D 35/285* (2013.01); *B65D 35/40* (2013.01)

(58) Field of Classification Search
CPC ..... B65D 35/285; B65D 35/40
USPC ..... 222/102
See application file for complete search history.

(56) References Cited

U.S. PATENT DOCUMENTS 1,295,433 A * 2/1919 Chipperfield ..... B65D 35/285 222/102
1,479,101 A * 1/1924 Prosper ..... B65D 35/285 222/102
1,728,147 A * 9/1929 Winsor ..... B65D 35/285 222/102

(Continued)

FOREIGN PATENT DOCUMENTS

DE 2 051 107 A1 4/1971
DE 2 138 661 A1 2/1973

(Continued)

OTHER PUBLICATIONS

International search report dated Nov. 19, 2019 of international application PCT/EP2019/076043 on which this application is based.

(Continued)

*Primary Examiner* — Paul R Durand
*Assistant Examiner* — Michael J. Melaragno
(74) *Attorney, Agent, or Firm* — Walter Ottesen, P.A.

(57) ABSTRACT

The disclosure relates to a device for emptying tubes. The device has at least one first and one second tooth roller, a housing, and an electric motor. The housing has at least one opening in the region of the two tooth rollers, the first tooth roller is arranged within the housing above the second tooth roller. The first tooth roller is freely rotatable, and the second tooth roller is driven by the electric motor. The two tooth rollers are in this case arranged one above the other such that a tube that is passed through the opening and between the two tube rollers with the tube fold at the front is drawn in by the rollers and the tube content can be pressed out of the tube.

20 Claims, 4 Drawing Sheets

(56) References Cited

U.S. PATENT DOCUMENTS 1,763,273 A * 6/1930 Strauss ..... B65D 35/285 222/102
1,784,752 A * 12/1930 Ries ..... B65D 35/285 222/102
1,841,275 A * 1/1932 Baptiste ..... B65D 35/285 222/96
1,842,000 A * 1/1932 Winsor ..... B65D 35/285 222/102
1,930,821 A * 10/1933 Newcomer ..... B65D 35/285 222/96
1,983,462 A * 12/1934 Johnson ..... B65D 35/285 222/102
2,001,983 A * 5/1935 Spiros ..... B65D 35/285 222/96
2,064,357 A * 12/1936 Ritterbusch ..... B65D 35/285 222/93
2,085,673 A * 6/1937 Roache ..... B65D 35/285 222/96
2,110,868 A * 3/1938 Coates ..... B65D 35/285 222/98
2,124,907 A * 7/1938 Bunting ..... B65D 35/28 222/93
2,357,351 A * 9/1944 Oliver ..... B65D 35/285 222/102
2,528,662 A * 11/1950 Miller ..... B65D 35/28 222/101
2,566,503 A * 9/1951 Snyder ..... B65D 35/285 222/102
2,578,472 A * 12/1951 Gunnarson ..... B65D 35/285 222/102
2,605,932 A * 8/1952 Locke ..... B65D 35/34 222/80
2,622,768 A * 12/1952 Hatcher ..... B65D 35/285 222/102
2,690,858 A * 10/1954 Justo ..... B65D 35/285 222/93
2,822,111 A * 2/1958 Tripoli ..... B65D 35/34 222/100
3,006,508 A * 10/1961 Preidel ..... B65D 35/285 222/98
3,197,072 A * 7/1965 Dick ..... B65D 35/285 222/102
3,198,389 A * 8/1965 Dunning ..... A47K 5/18 222/93
3,217,930 A * 11/1965 Battaglini ..... B65D 35/285 222/93
3,221,940 A * 12/1965 Watson, Jr. ..... B65D 35/285 222/96
3,233,784 A * 2/1966 Gordon ..... B65D 35/285 222/98
3,313,454 A * 4/1967 Welsh ..... B65D 35/285 222/102
3,332,579 A * 7/1967 Peters ..... B65D 35/285 222/96
3,581,943 A * 6/1971 Koenigshof ..... B65D 35/285 222/102
3,586,213 A 6/1971 Gill
3,606,090 A * 9/1971 Byers ..... B65D 47/2075 222/102
3,701,459 A * 10/1972 Ward ..... B65D 35/285 222/102
3,737,078 A * 6/1973 Thoren ..... B65D 35/285 222/192
3,738,533 A * 6/1973 Bertrand ..... B65D 35/285 222/102
3,747,806 A * 7/1973 Goings ..... B65D 35/285 222/102
3,822,033 A 7/1974 Hopf
3,860,147 A * 1/1975 Vessio ..... B65D 35/285 222/96
3,917,118 A * 11/1975 Odgen ..... B65D 35/34 222/100
3,938,474 A * 2/1976 Goings ..... B65D 35/34 222/102
3,946,904 A * 3/1976 Mulakala ..... B65D 35/285 222/102
3,970,220 A * 7/1976 Spears ..... B65D 35/285 222/102
3,999,688 A * 12/1976 Hicks ..... B65D 35/285 222/102
4,030,636 A * 6/1977 Drancourt ..... B65D 35/285 222/102
4,213,542 A * 7/1980 Wilson ..... B65D 35/285 222/102
4,226,336 A * 10/1980 Young ..... B65D 35/285 222/102
4,258,864 A * 3/1981 Karamanolis ..... B65D 35/34 222/101
4,354,623 A * 10/1982 Gill ..... B65D 35/285 222/102
4,403,714 A * 9/1983 Kane ..... B65D 35/28 222/101
4,421,251 A * 12/1983 Namdari ..... B65D 35/285 222/104
4,548,337 A * 10/1985 Morris ..... B65D 35/28 222/105
4,946,070 A * 8/1990 Albert ..... A47K 5/1215 222/52
4,946,072 A * 8/1990 Albert ..... A47K 5/1217 222/105
4,978,034 A * 12/1990 Vishnevetsky ..... B65D 35/285 222/102
5,050,773 A * 9/1991 Choi ..... B65D 35/285 222/63
5,118,011 A * 6/1992 Kopp ..... B65D 35/285 222/102
5,131,567 A * 7/1992 Lipsey ..... B65D 35/285 222/102
5,178,302 A * 1/1993 Cheng ..... B65D 35/285 222/102
5,195,659 A * 3/1993 Eiskant ..... B65D 35/285 222/102
5,203,473 A * 4/1993 Willey ..... B65D 35/34 222/100
5,215,218 A * 6/1993 Choi ..... B65D 35/285 141/355
5,297,699 A * 3/1994 Barchus ..... B65D 35/285 222/102
5,372,282 A * 12/1994 Barchus ..... B65D 35/285 222/102
5,441,172 A * 8/1995 Yu ..... A47K 5/122 222/102
5,447,255 A * 9/1995 Smedley ..... B65D 35/285 222/102
5,511,696 A * 4/1996 Gustafson ..... B65D 35/285 222/102
5,573,138 A * 11/1996 Lin ..... B65D 35/285 222/102
5,638,840 A * 6/1997 Lee ..... A47K 5/18 132/310
5,845,813 A * 12/1998 Werner ..... B65D 35/285 222/101
5,875,929 A * 3/1999 Nguyen ..... B65D 35/285 222/102
5,957,334 A * 9/1999 Rosario ..... B65D 35/285 222/102
5,963,136 A * 10/1999 O'Brien ..... G16H 40/67 340/573.1
6,010,570 A * 1/2000 Motoda ..... H01L 21/6715 118/323
6,089,405 A * 7/2000 Schmitt ..... B65D 35/285 222/102
6,296,150 B1 * 10/2001 Farris ..... A61M 1/83 222/95
6,662,971 B1 * 12/2003 Nguyen ..... B65D 35/285 222/101
6,749,088 B1 * 6/2004 Holevas ..... A46B 11/0048 132/311

(56) References Cited

U.S. PATENT DOCUMENTS 6,880,726 B1 * 4/2005 Perez ..... B65D 35/28 222/102
6,896,154 B1 * 5/2005 Lomeli ..... A47K 1/09 222/101
6,966,457 B1 * 11/2005 Torbet ..... B65D 35/285 222/101
6,968,978 B1 * 11/2005 Matthews ..... B65D 35/28 222/103
7,111,758 B1 * 9/2006 Monks ..... A47K 1/09 222/102
7,191,777 B2 * 3/2007 Brand ..... A61M 15/008 128/200.23
7,441,674 B2 * 10/2008 Schroeder ..... B67D 1/0001 141/27
7,581,661 B2 * 9/2009 Thomas ..... B65D 35/28 222/102
7,669,735 B1 * 3/2010 Alleyne ..... B65D 35/285 222/102
7,950,549 B1 * 5/2011 Harris ..... B05C 17/00596 222/333
8,418,891 B1 * 4/2013 Harris ..... A21C 15/005 222/333
8,434,644 B1 * 5/2013 Galante ..... B65D 35/285 222/102
9,504,346 B2 * 11/2016 Sorsavirta ..... A47J 9/005
10,459,460 B2 * 10/2019 Carlson ..... A47K 5/1217
10,703,061 B1 * 7/2020 Hovhannisyan ..... B30B 3/04
10,867,695 B2 * 12/2020 Neagle, III ..... A61B 5/0002
2001/0016710 A1 * 8/2001 Nason ..... A61M 5/1452 604/153
2001/0050290 A1 * 12/2001 Sampson ..... B65D 35/28 222/102
2002/0092879 A1 * 7/2002 Chrisman ..... B67D 7/0216 222/504
2002/0170923 A1 * 11/2002 Vatman ..... B65D 35/285 222/102
2003/0102327 A1 * 6/2003 Friedman ..... B65D 35/28 222/101
2004/0040980 A1 * 3/2004 Chen ..... B65D 35/28 222/101
2004/0094573 A1 * 5/2004 Danby ..... B67D 1/1231 222/102
2006/0255065 A1 * 11/2006 Crosby ..... A47K 1/09 222/102
2008/0237259 A1 * 10/2008 Fuchs ..... A47K 5/1215 222/101
2009/0302054 A1 * 12/2009 Cragnolini ..... B65D 35/34 222/1
2009/0302057 A1 * 12/2009 Matzel ..... B65D 35/40 222/102
2010/0127016 A1 * 5/2010 Leung ..... B65D 35/28 222/102
2010/0159416 A1 * 6/2010 Lee ..... A61C 17/227 433/87
2010/0163573 A1 * 7/2010 Wegelin ..... A47K 5/1217 222/1
2010/0282775 A1 * 11/2010 Damallie ..... B65D 35/285 222/96
2012/0267394 A1 * 10/2012 Pierson ..... A61C 9/0026 222/94
2013/0341353 A1 * 12/2013 Harris ..... A47K 5/18 222/102
2018/0184857 A1 * 7/2018 Pai ..... A46B 9/04
2018/0185608 A1 * 7/2018 Bogin ..... A61M 16/024
2020/0330938 A1 * 10/2020 Singh ..... B01F 11/0065

FOREIGN PATENT DOCUMENTS

DE 27 48 838 A1 5/1979
DE 30 07 015 A1 9/1981
DE 43 38 273 A1 6/1994
DE 296 21 050 U1 3/1997
DE 199 23 183 A1 11/2000
EP 0 047 447 A1 3/1982
GB 2 336 353 A 10/1999

OTHER PUBLICATIONS

English translation of the Written Opinion of the International Searching Authority dated Nov. 19, 2019 of International application PCT/EP2019/076043 on which this application is based.

* cited by examiner

DEVICE FOR SQUEEZING OUT TUBES

CROSS REFERENCE TO RELATED APPLICATIONS

This application is a continuation application of international patent application PCT/EP2019/076043, filed Sep. 26, 2019, designating the United States and claiming priority from German application 10 2018 124 694.3, filed Oct. 8, 2018, and the entire content of both applications is incorporated herein by reference.

TECHNICAL FIELD

The disclosure relates in general to a device for emptying tubes. In particular, the disclosure relates to a device for extruding tubes.

BACKGROUND

A lot of paste-like formulations, in particular cosmetic formulations like toothpaste, face cream or hair tinting lotions, as well as components used in the craft trade sector like glues or special components, are filled into tubes for trading purposes. The tubes may be built from metal or polymeric material, depending on the tube content.

The consumer tends to empty the tube completely in order to apply as much as possible content. This applies largely to tubes with valuable and thus cost intensive contents. Further, it applies to commercial users, who use a great many tubes, for example hair dressers using hair tinting lotions, whose components are traded in tubes and are relatively cost intensive. Hence, emptying the tubes completely may have a strong effect on the expense factor.

Metal tubes may be emptied by hand by coiling. Since with metal tubes no loosening of the coil occurs, the position of the end of the tube and thus the starting point for coiling refers to the actual degree of emptying of the tube. Nevertheless, the manual coiling process is quite time consuming, which is in particular disadvantageous in the commercial sector.

Further, when using tubes made from polymeric materials, there is the problem that coils in tubes being partially coiled are loosened due to the elastic tube material. When the coils are loosened, the tube content is partially sucked back from the tube opening into the tube. Hence, when using the tube again, the whole coiling process has to be repeated, starting from the tube fold.

To solve this problem, devices are described in prior art, which prevent the partially emptied tube from uncoiling. DE 43 38 273 describes a rewinder for coiling plastic tubes, which enables the user to empty the tube almost completely. Further, the tube ends are coiled without leaving an interspace between the coils. The device includes a winding mandrel and a winding steel. The pressure required to compress the tube is applied by the winding steel.

The European patent application EP 0 047 447 A1 describes a key-like device for emptying plastic tubes by coiling and squeezing. The device includes a handle with a twist lock, preventing the tube from relaxing and uncoiling.

However, in both devices the coiling occurs by a manual process. Further, the tubes stay inside the devices until they are completely empty. Hence, when several tubes are used, several devices are needed. Moreover, mounting the device to the tube and the manual process for emptying the tubes is time consuming and requires strength. Additionally, the sizes of tubes and devices have to match.

SUMMARY

Therefore, it is an object of the invention to provide a device for emptying tubes, which is in particular suitable for emptying plastic tubes fast and with no effort. Further, the device should be suitable for emptying a plurality of tubes of different dimensions.

The aforementioned object can, for example, be achieved via a device for emptying tubes including: a first tooth roller; a second tooth roller; a housing defining an opening in a region of the first tooth roller and the second tooth roller; an electric motor; the first tooth roller being arranged within the housing above the second tooth roller; the first tooth roller being freely rotatable; the second tooth roller being configured to be driven by the electric motor with a torque in a range of 10 to 100 Ncm; and, the first tooth roller and the second tooth roller being arranged one above the other such that a tube that is passed through the opening and between the first tube roller and the second tube roller with a tube fold at the front is drawn in by the first and second tooth rollers and a tube content can be pressed out of the tube.

The device for squeezing out tubes according to the disclosure includes at least a housing, a first and a second tooth roller and an electric motor for driving the second tooth roller. In the housing, the two tooth rollers are arranged one above the other. The first tooth roller is freely rotatable, while the second tooth roller is driven by the electric motor. The housing has an opening in the region of the two tooth rollers, where a tube fold may be inserted into the housing.

During operation, the two tooth rollers are spaced apart from each other such that a tube fold being inserted through the opening of the housing is drawn in by the tooth rollers. In particular, the tube fold is drawn in by the tooth rollers due to sticking friction. Contrary to the devices known from the state of the art, the tube fold is not fixed by the device according to the disclosure. Hence, the tube is pulled into the housing by the movement of the tooth rollers, while no coiling of the tube occurs. Due to the movement of the tooth rollers and the performed pressure of the tooth rollers on the tube, the tube content is squeezed in the direction of the tube opening and can be easily pressed out of the tube. Thus, the tube is neither being coiled nor being rolled up in the device. This is advantageous, since the tube or the squeezed tube fold, respectively, may be removed from the device in a facile way via hand when the motor is switched off. Since a disassembly of the device is not necessary to remove the tube, the device is ready to use again in a short time.

The first tooth roller is constructed as a nip roll, wherein the second tooth roller is driven by the electric motor. Preferably, the first tooth roller is arranged above the second tooth roller. Due to the electric drive of the second tooth roller, it is possible to empty the tube fast and with no effort.

According to an embodiment, the electric drive of the electric motor is transferred to the second tooth roller by a timing belt and a synchronized pulley. In particular, the synchronized pulley is constructed in a way that the second tooth roller is powered with high torques. Preferably, the torques are in the range between 10 to 100 Ncm, more preferably in the range of 15 to 30 Ncm. This ensures that the contact pressure is high enough to press the tube content into the direction of the tube opening also when sturdy plastic tubes are used. At the same time, damaging of the tube material, for example, by rupturing the tube material due to too high torques is avoided.

According to an embodiment, the two tooth rollers are arranged in such a way that they are distanced to each other in a non-operating state of the device. Hence, there is a slit between the two tooth rollers, which allows entering the tube fold in a particularly facile matter. In this embodiment, the first tooth roller is arranged flexible in the device. In particular, the first tooth roller is arranged in such a way that it can be moved in y-direction, that is, vertically. During operation of the device, the first tooth roller is pressed downwards in the direction of the second tooth roller by applying pressure to the housing, so that the teeth of the two tooth rollers interlock. By interlocking, the tube is pressed out through the roller movement. The pressure applied to the housing may be achieved manually by the operator. The pressure or the force applied by the operator may further be used for the emptying process of the tube in addition to the electric motor. Hence, the housing is preferably at least a two-part housing. The lower part of the housing is fixed, while the upper part of the housing may perform a stroke movement towards the lower housing part. Hence, the upper housing part shows a tolerance or backlash towards the lower housing part. The first tooth roller is fixed at the upper housing part. Hence, the upper housing parts as well as the upper tooth roller are moved downwards by applying a pressing movement on the upper housing part, for example, by a pressing movement of the operator's hand.

According to an embodiment, the teeth of the tooth rollers show a flattened profile. In particular, the teeth show a quadrangular, preferably a rectangular or trapezoid profile. This is advantageous, since the profile ensures a high sticking friction between the tube and the tooth rollers, thereby avoiding an overrun of the rollers. Hence, the tube is transported by the tooth rollers. During transport, the tooth rollers press the tube content towards the tube opening. At the same time, the flattened profile of the teeth prevents damaging the tube, for example, by tearing the tube walls.

In particular, it turned out, that using tooth rollers with teeth showing a rectangular or at least almost rectangular profile, wherein the distance z between single teeth is higher than the width b of a single tooth, is advantageous.

According to one embodiment, the tooth rollers are built in a manner that when using metal tubes, the profile of the tooth roller is transferred onto the surface of the tube. This enables an almost complete emptying of the tube. At the same time, the transferred profile of the rollers seals the evacuated part of the tube, so that it is difficult or even impossible for the tube content to re-enter the evacuated part of the tube. This is particularly advantageous when the tube is squeezed multiple times while using in order to reduce the volume of the tube, thereby squeezing the content in the direction of the tube opening.

The housing shows at least one opening being located at the height of the tooth rollers. The tube or the tube fold is drawn in by the tooth rollers through this opening. According to an embodiment, there is a second opening in the housing located across from the first opening in the height of the tooth rollers. The tube fold can be pushed out of the device through the second opening. Hence, it is possible to completely empty tubes showing a length longer than the device. Since the depth of the device, that is, the size of the device measured in the transport direction of the tube, is restricted only by the size of the electronic motor and the tooth rollers but not by the dimensions of the tube, it is possible to build the device in a compact set-up. According to an embodiment, at least one opening in the housing includes a guidance for entering the tube fold into the housing. Preferably, the guidance is funnel-shaped. The handling of the device is further simplified by providing a funnel-shaped guidance, since the guidance ensures automatically a correct position of the tube when entering the housing, so that the tooth rollers feed the tube in.

In an embodiment, the width of the device depends mainly on the length of the teeth rollers used. Preferably, the tooth rollers show a length between 5 and 15 cm, more preferred between 7 and 10 cm. The aforementioned enables the device to empty a wide range of different tube sizes and tube types.

The electronic motor can be switched on and off by a simple push button. However, according to an embodiment, the motor is switched on by applying pressure to the housing. Hence, the housing is a two-piece housing. The lower part of the housing is fixed, while the upper part of the housing may perform a stroke movement with regard to the lower part of the housing. Hence, the upper part of the housing shows a backlash. By pressing the upper part of the housing, for example, by hand pressure, the upper part of the housing is moved downwards, thereby simultaneously tripping a switch to switch on the electronic motor. The handling is intuitive and can be performed one handed. The switch can be constructed in a way that an electric power supply of the motor is only provided as long the upper part of the housing is pressed downwards.

Alternatively, the device may include an automatic shut-off of the electric motor. Here, the motor is switched off as soon as the tube has been completely emptied. In the case of a complete emptying, the tooth rollers feed the tube in up to the tube opening. Due to its geometrical shape, the tooth rollers can't pull the tube opening inside the device. Hence, the tube opening is stuck in front of the opening of the housing or the guiding device, respectively. In case the device or motor is provided with a DC-switch off, the final position of the tube and thus the end of the squeezing process may be determined by measuring the motor current. When the tube has been completely emptied, no further feed in of the tube is possible due to the geometric shape of the tube opening. Hence, the motor is driven up to a limit stop and blocking occurs, leading to an increase of the motor current. The motor is switched off automatically by monitoring the motor current by serial connection of motor and a current-sensing resistor. A micro controller evaluates the current profile, switching off the motor in case an increase of the motor current is detected.

According to an embodiment, the device includes a counter for detecting the number of performed emptying events. For example, it is possible to record the number of tubes which have been emptied.

Alternatively or additionally, the device may include a dosing unit for dosing the content of the tube. According to this embodiment, the tube is not emptied completely, but a predetermined amount of tube content is squeezed out of the tube. This may be achieved by running the electric motor for a predetermined duration at a constant power. Hence, a constant amount of tube content is squeezed out of the tube by each switch-on procedure of the motor. In an embodiment, the device includes additionally a device for tube recognition, for example, via a bar code or QR-code. Hence, it is possible to adjust the delivered amount of tube content depending on the specific tube type in an automatic process.

Alternatively or additionally, the device includes a device for tube recognition mounted at the housing of the device. In particular, the device for tube recognition may be a device for tube recognition via bar code, QP-code or RFID-chip. The tube is placed by the user in a position to the device for recognition manually, so that the chip or code on the tube may be read out by the device for recognition.

According to an embodiment, the device for tube recognition is connected to a computer or a mobile terminal. In particular, the device is connected by LAN-cable, WLAN, radio communication or Bluetooth. It is thus for example possible to register the tube and to administer the stock by using a software program, for example, an application (app). When the program or application is connected with the internet, an automatic reorder of the detected tube may be placed.

BRIEF DESCRIPTION OF THE DRAWINGS

The invention will now be described with reference to the drawings wherein.

DESCRIPTION OF THE PREFERRED EMBODIMENTS

Figure 1:
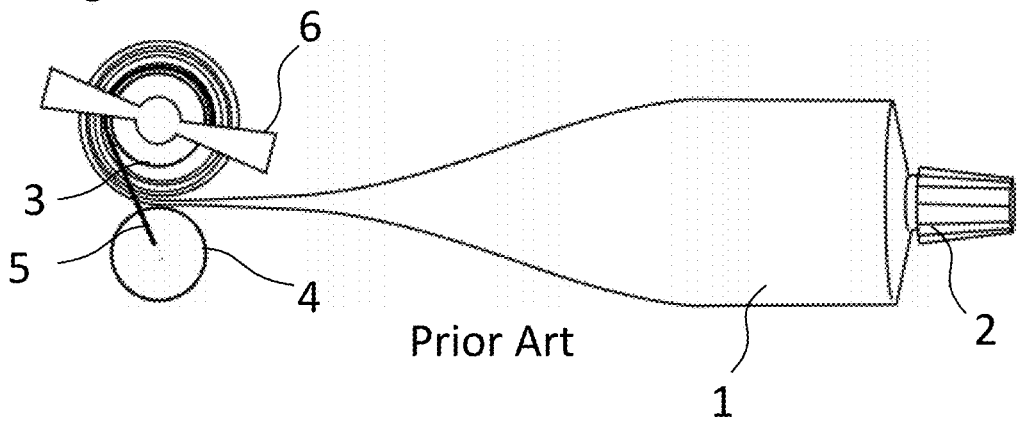
FIG. 1 shows a device for emptying tubes according to prior art.

FIG. 1 shows a device for emptying tubes according to the prior art, as shown in DE 43 38 273 A1. By using the shown device, it is possible to empty a tube 1 almost completely. The tube is emptied by coiling the end of the tube on a winding mandrel with a spring steel construction without interspaces. The device includes a mandrel 3 and a hull 4. The mandrel 3 is driven by hand via the handle 6. Both mandrel 3 and hull 4 show a smooth surface without any profile. The spring steel construction 5 presses the hull 4 onto the mandrel 3, thereby generating the pressure required to squeeze tube 1. Using the wing nut 6, the tube 1 is coiled up by hand and the content of the tube is squeezed in the direction of the tube opening. The tube 1 remains inside the device until it has been emptied completely. Here, tube 1 is coiled up in the device until its opening 2 is reached. To remove tube 1 from the device, it is necessary to turn mandrel 3 by handle 6 by hand, so that tube 1 is unwound. Hence, the process of emptying tube 1 as well as removing the partially or completely emptied tube 1 from the device is time-consuming.

Figure 2A:
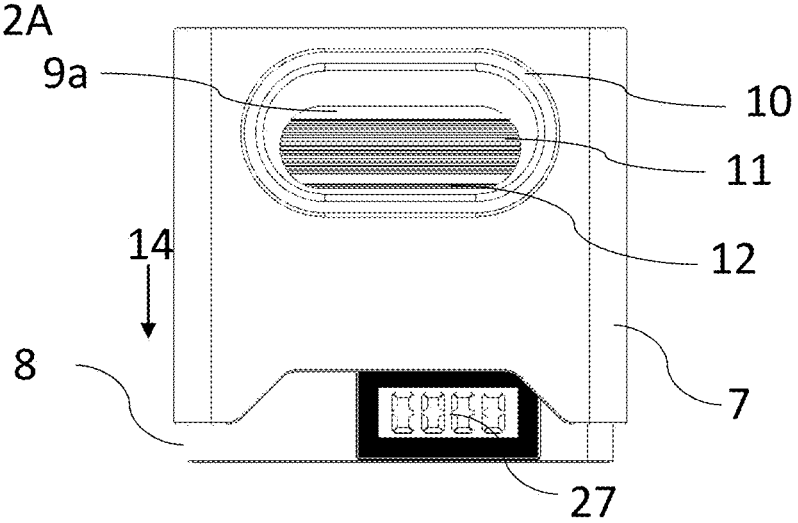
FIG. 2A and FIG. 2B show schematic representations of an embodiment.
Figure 2B:
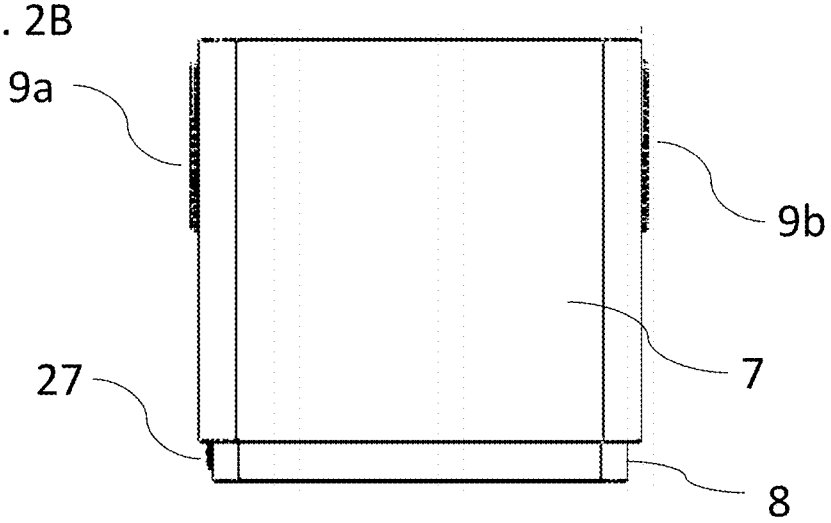

FIGS. 2A and 2B show an embodiment of the device according to the disclosure. The front of the device is shown in FIG. 2A, while FIG. 2B provides a side view of the device. The device includes a two-parts housing 7, 8. The upper part of the housing 7 is movable relative to the lower housing part 8. Hence, by applying pressure onto the top face of the upper part of the housing 7, a stroke movement can be performed in the direction of the lower housing part 8. The stroke movement is symbolized by arrow 14. The stroke movement further starts the electric motor inside the housing (not shown) driving the second tooth roller 12, so that second tooth roller 12 rotates. Further, first tooth roller 11 is moved towards second tooth roller 12. Thus, the interspace between tooth rollers 11, 12 during operation is smaller than in rest mode.

The first tooth roller 11 is freely rotatable and functions as a nip roll. The upper part of the housing 7 includes two openings 9*a*, 9*b*, located in the height of the tooth rollers 11, 12. Opening 9*a* is located on the front side of the device and includes a guiding device 10. Guiding device 10 shows a funnel-shaped geometry. This facilitates inserting a tube or a tube fold, respectively, through opening 9*a*. The tube fold inserted into the device through opening 9*a* and the tooth rollers 11, 12 is transported in direction of opening 9*b* located on the opposite side of the device. The tube is not coiled, but flattened. At the same time, the teeth of the tooth rollers 11, 12 compress the tube and the content of the tube is pressed towards the tube opening 2. In case the length of the tube b is bigger than the depth of the device d, the tube fold may exit the device through housing opening 9*b*. Opening 9*a* and guiding device 10 are constructed in a way that the height of opening 9*a* is smaller than the diameter of the tube opening 2. This ensures that the upper part of the tube including the opening 2 is not pulled inside the device by the tooth rollers 11, 12. In the embodiment shown in FIGS. 2A and 2B, the motor includes an automatic shut-off. When it is no longer possible to insert the tube further into the device, the motor is shut off. Further, the device includes a counting unit 27 to determine the number of emptying processes.

Figure 3A:
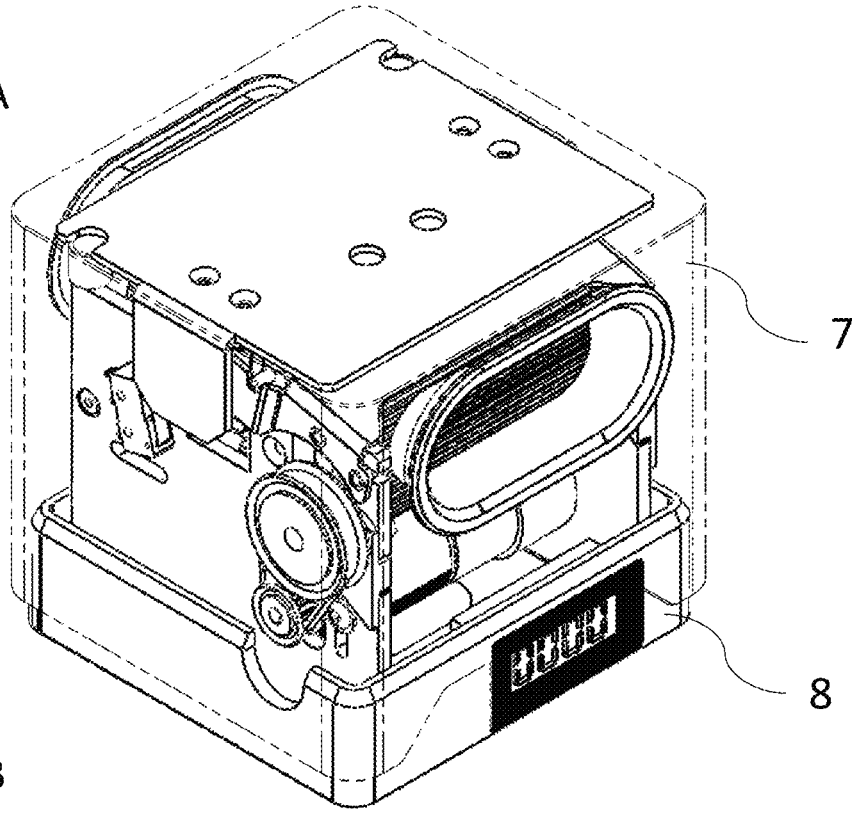
FIG. 3A and FIG. 3B show schematic representations of an embodiment without housing.
Figure 3B:
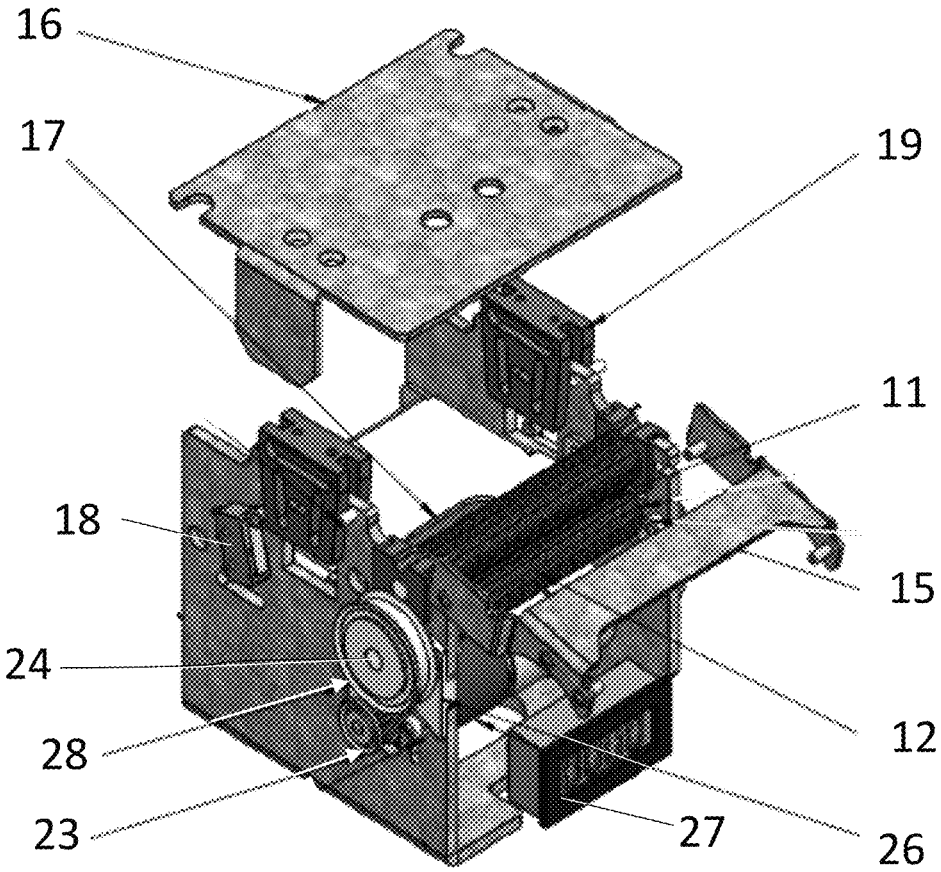

FIGS. 3A and 3B show schematic representations of an embodiment of the device. FIG. 3B is an exploded assembly. The housing is not shown for the sake of clarity. To press down slide 19 and thus to turn tumbler switch 18, the device includes a bracket 16. The electric motor 26 is started by turning tumbler switch 18. According to the embodiment shown in FIGS. 3A and 3B, the electric motor 26 is a 12 V DC-motor. The motor 26 drives a synchronized pulley 23. The synchronized pulley 23 is connected with another synchronized pulley 24 through the timing belt 28. The synchronized pulley 24 drives tooth roller 12. In order to achieve higher torques, the diameter of synchronized pulley 24 is bigger than the diameter of synchronized pulley 23. Higher torques, in particular torques in the range between 15 to 30 Ncm are advantageous, since with these torques, the tube is slowly transported by tooth rollers 11, 12, thereby being squeezed out with high load. Tooth roller 11 is freely rotatable and functions as a nip roll.

Further, the device includes a guide plate 17 and a yoke 15 to shield the electric motor 26, thereby preventing that a tube inserted into the device may contact the electric motor 26.

In the embodiment according to FIGS. 2A, 2B, 3A and 3B, the upper housing part 7 has a width of 120 mm and a depth d of 117 mm. The height of the housing is 119 mm.

Figure 4:
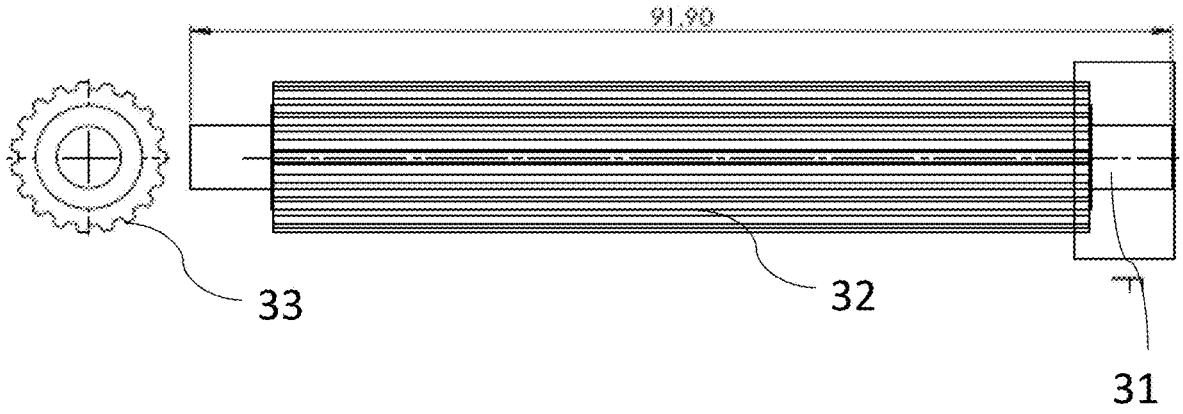
FIG. 4 shows schematic representation of the tooth profile of a tooth roller according to an embodiment.

FIG. 4 shows the used tooth rollers 11, 12. In this embodiment, the tooth roller has a total length of ca. 77 mm (without hanger assembly 31). Hence, tubes with a fold with up to 77 mm can be emptied or squeezed with the device. The rollers show a profile 32 with trapezoid teeth 33.

Figure 5:
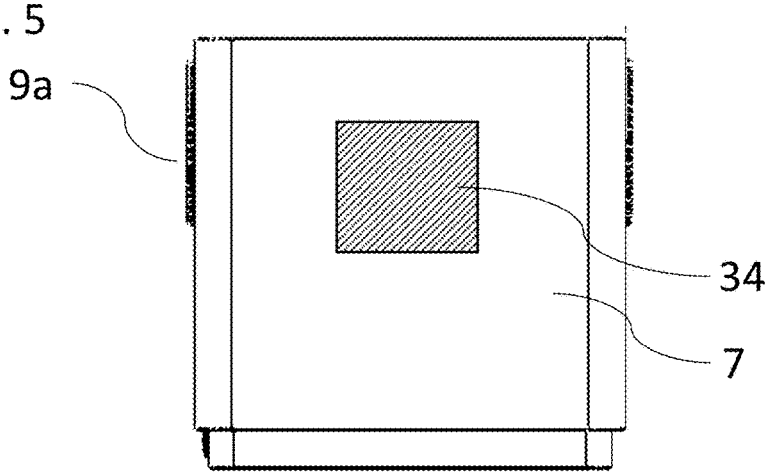
FIG. 5 shows a schematic representation of an embodiment with a device for tube recognition.

FIG. 5 shows a schematic representation of an embodiment including a device for tube recognition 34. According to this embodiment, the device for tube recognition 34 is a scanner and is mounted onto one of the side faces of the housing 7. For example, after complete emptying of a tube inserted into the device, the user can scan the tube with the tube recognition device. By connecting the device for tube recognition with a computer or mobile terminal (not shown), the tube scanned with the device for tube recognition may be managed with an appropriate program. For example, it can be configured in a way that after scanning a tube with the device for tube recognition 34, the tube is identified by the program as being empty. When connected to the internet, a reorder of the tube may be carried out automatically.

Figure 6A:
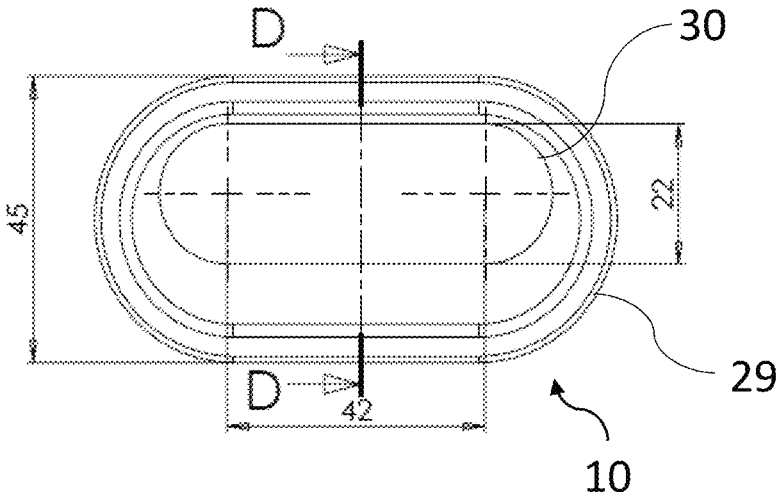
FIGS. 6A and 6B show schematic representations of a guiding device; and, FIG. 7 shows a photographic picture of an empty metal tube.
Figure 6B:
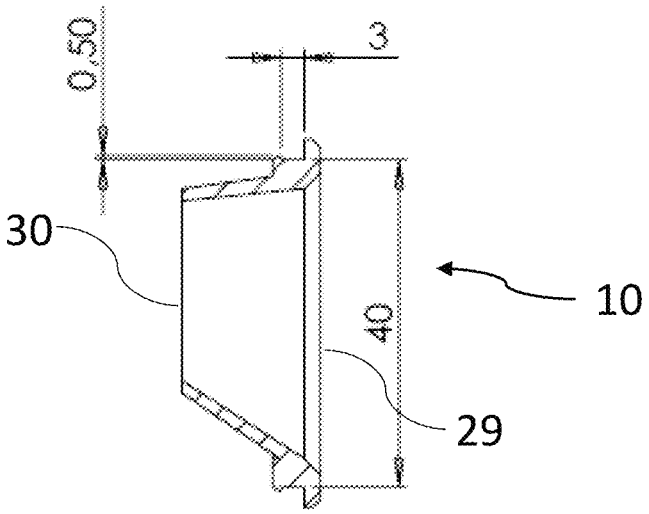

FIGS. 6A and 6B show schematic representations of a guiding device 10 in top view (FIG. 6A) and in cross section (FIG. 6B). The guiding device 10 shows a funnel-shaped form. The front opening 29, that is, the opening of the guiding device through which the tube fold is guided, is bigger than the opening in the back 30. According to one embodiment, the height of the front opening 29 is 40 mm and the region of the back opening 30 is 22 mm. The guiding device 10 shows only at one side a funnel-shaped form. Hence, it is possible to insert and squeeze the tube up to its opening.

Figure 7:
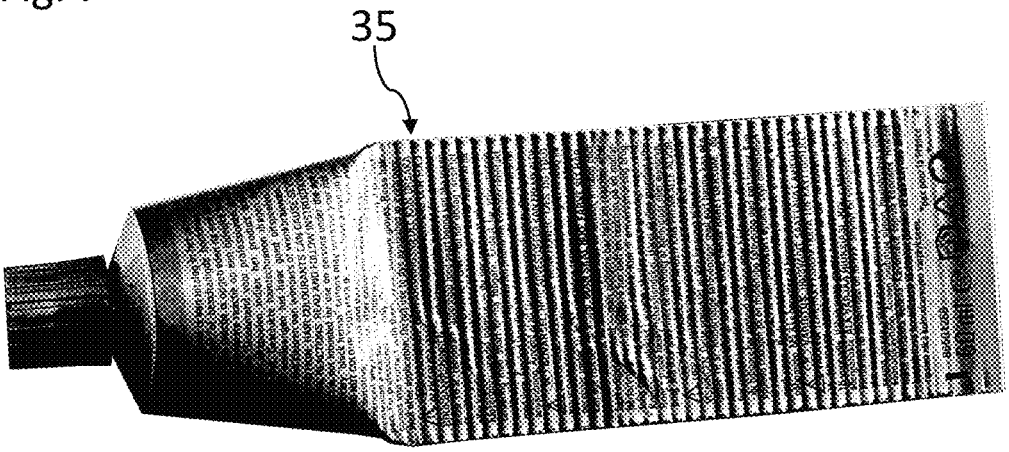

FIG. 7 shows a photograph of a metal tube 35, which has been emptied with the device according to the disclosure. The profile of the tooth rollers 11, 12 has been transferred to the tube 35, thereby compressing the tube 35.

It is understood that the foregoing description is that of the preferred embodiments of the invention and that various changes and modifications may be made thereto without departing from the spirit and scope of the invention as defined in the appended claims.

What is claimed is:

1. A device for emptying tubes comprising:
- a first tooth roller;
- a second tooth roller;
- a housing defining a first opening in a region of said first tooth roller and said second tooth roller and a second opening;
- an electric motor;
- said first tooth roller being arranged within said housing above said second tooth roller;
- said first tooth roller being freely rotatable;
- said second tooth roller being configured to be driven by said electric motor with a torque in a range of 10 to 100 Ncm;
- said first tooth roller and said second tooth roller being arranged one above the other such that a tube that is passed through said opening and between said first tooth roller and said second tooth roller with a tube fold at the front is drawn in by said first and second tooth rollers and a tube content can be pressed out of the tube; and
- wherein said second opening is arranged in a side of said housing opposite to said first opening so that the tube fold that is passed through said first opening by said first and second tooth rollers inside the device may be pushed through said second opening, thereby exiting from the device.

2. The device of claim 1, wherein said second tooth roller is configured to be driven by a synchronising disc via a timing belt.

3. The device of claim 1, wherein said first tooth roller and said second tooth roller include teeth with an at least four-sided profile.

4. The device of claim 3, wherein said profile is a trapezoidal profile or a rectangular profile.

5. The device of claim 1 further comprising a guide for said opening in said housing configured to aid an insertion of the tube fold into the device.

6. The device of claim 1 further comprising a funnel-shaped guide configured to aid an insertion of the tube fold into the device.

7. The device of claim 1, wherein said first tooth roller is constructed as a nip roll.

8. The device of claim 1, wherein said second tooth roller is the only toothed roller driven by said electric motor.

9. A device for emptying tubes comprising:
- a first tooth roller;
- a second tooth roller;
- a housing defining an opening in a region of said first tooth roller and said second tooth roller;
- an electric motor;
- said first tooth roller being arranged within said housing above said second tooth roller;
- said first tooth roller being freely rotatable;
- said second tooth roller being configured to be driven by said electric motor with a torque in a range of 10 to 100 Ncm;
- said first tooth roller and said second tooth roller being arranged one above the other such that a tube that is passed through said opening and between said first tooth roller and said second tooth roller with a tube fold at the front is drawn in by said first and second tooth rollers and a tube content can be pressed out of the tube;
- wherein said housing is constructed from at least two parts, said two parts including an upper part and a lower part, said upper part of said housing being configured to perform a stroke movement towards said lower part of said housing; and, said electric motor is switched on by the stroke movement.

10. The device of claim 1 further comprising an automatic switch configured to switch off said electric motor as soon as the tube has been completely emptied.

11. The device of claim 1, further comprising a counting unit configured to determine a number of tubes which have already been emptied.

12. The device of claim 1 further comprising a dosing unit for dosing the tube content.

13. The device of claim 12, wherein the dosing unit is configured to control a run-time of said electric motor; and, said electric motor is configured to run for a predetermined duration at a constant power, so that every switch-on procedure leads to a constant amount of tube content squeezed out of the tube.

14. A device for emptying tubes comprising:
- a first tooth roller;
- a second tooth roller;
- a housing defining an opening in a region of said first tooth roller and said second tooth roller;
- an electric motor;
- said first tooth roller being arranged within said housing above said second tooth roller;
- said first tooth roller being freely rotatable;
- said second tooth roller being configured to be driven by said electric motor with a torque in a range of 10 to 100 Ncm;
- said first tooth roller and said second tooth roller being arranged one above the other such that a tube that is passed through said opening and between said first tooth roller and said second tooth roller with a tube fold at the front is drawn in by said first and second tooth rollers and a tube content can be pressed out of the tube;
- said first tooth roller and said second tooth roller being arranged in a mutually spaced relationship in a non-operating state of the device; and,
- said first tooth roller being mounted in the housing so as to be moveable in a direction of said second roller during operation of the device.

15. The device of claim 14, wherein said first tooth roller is constructed as a nip roll.

16. The device of claim 14, wherein the device comprises a tube recognition device.

17. The device of claim 16 further comprising a reader configured to read at least one of a bar code, a QR-code, and an RFID-chip.

18. The device of claim 16, wherein said tube recognition device is mounted to said housing.

19. The device of claim 16, wherein said tube recognition device is connected to at least one of a computer and a mobile terminal.

20. The device of claim 16, wherein said tube recognition device is connected to at least one of a computer and a mobile terminal via at least one of a LAN-cable, WLAN, radio communication, and Bluetooth.

* * * * *